US005701875A

United States Patent [19]

Judd

[11] Patent Number: 5,701,875

[45] Date of Patent: Dec. 30, 1997

[54] IGNITION ASSEMBLY ADAPTER SYSTEM

[76] Inventor: Kit Judd, 705 N. Arizona Ave, Wilcox, Ariz. 85643

[21] Appl. No.: 738,401

[22] Filed: Oct. 25, 1996

[51] Int. Cl.[6] ..... F02P 29/004

[52] U.S. Cl. ..... 123/595

[58] Field of Search ..... 123/595, 146.507; 200/19 DC

[56] References Cited

U.S. PATENT DOCUMENTS

| | | | |
|---|---|---|---|
| 2,619,513 | 11/1952 | Wolfenbarger | 123/596 |
| 3,822,686 | 7/1974 | Gallo | 123/595 |
| 4,526,157 | 7/1985 | Theofanous | 123/595 |
| 4,658,103 | 4/1987 | McAbee et al. | 200/19 DC |
| 4,710,598 | 12/1987 | McAbee et al. | 200/21 |

*Primary Examiner*—Raymond A. Nelli

[57] ABSTRACT

A new combustion engine assembly adapter system for adapting ignition systems for use on engines not originally equipped with ignition systems. The inventive device includes an ignition assembly support for mounting an ignition distributor on a combustion engine and further including a drive assembly for transferring the rotational movement of the camshaft of the combustion engine to the ignition assembly. The ignition assembly support is mounted on the exterior of the combustion engine and has a sleeve member for receiving the cylindrical mounting portion of an ignition distributor so that the distributor is supported external to the engine.

7 Claims, 3 Drawing Sheets

IGNITION ASSEMBLY ADAPTER SYSTEM

BACKGROUND OF THE INVENTION

1. Field of the Invention

The present invention relates to combustion engine ignition systems and more particularly pertains to a new apparatus for adapting ignition systems for use on engines not originally equipped with ignition systems, especially electronic ignition systems.

2. Description of the Prior Art

The use of combustion engine ignition systems is known in the prior art. More specifically, combustion engine ignition systems heretofore devised and utilized are known to consist basically of familiar, expected and obvious structural configurations, notwithstanding the myriad of designs encompassed by the crowded prior art which have been developed for the fulfillment of countless objectives and requirements. Furthermore, the concept of converting the fuel systems of combustion engines from delivering one type of fuel to another type of fuel is generally known (e.g., from a fuel system delivering a diesel type fuel to one delivering compressed natural gas), such as illustrated in U.S. Pat. Nos. 5,329,908; 5,224,457; 5,370,097; 5,373,700; 5,315,981 and U.S. Pat. No. 5,330,031.

While these devices fulfill their respective, particular objectives and requirements, the aforementioned patents and the prior art do not disclose the concept and practice of converting combustion engines not originally equipped or engineered with an ignition system to one employing an ignition system comprised of widely available ignition components for improved operation. Such a conversion system would find particularly beneficial use in converting diesel fuel burning engines to natural gas burning engines, such as may be used in irrigation systems, to name one exemplary application of such a system.

In these respects, the Ignition Assembly Adapter System according to the present invention substantially departs from the conventional concepts and designs of the prior art, and in so doing provides an apparatus primarily directed to the purpose of permitting the use of ignition systems on combustion engines not originally equipped with ignition systems.

SUMMARY OF THE INVENTION

In view of the foregoing disadvantages inherent in the known types of combustion engine ignition systems now present in the prior art, the present invention provides a new Ignition Assembly Adapter System construction wherein the same can be utilized for permitting the use of ignition systems on combustion engines not originally equipped with ignition systems.

The general purpose of the present invention, which will be described subsequently in greater detail, is to provide a new Ignition Assembly Adapter System which has many novel features that result in a new Ignition Assembly Adapter System which is not anticipated, rendered obvious, suggested, or even implied by any of the prior art combustion engine ignition systems, either alone or in any combination thereof.

To attain this, the ignition assembly adapter system of the present invention generally comprises an ignition assembly support for mounting an ignition assembly (e.g., an ignition distributor) on a combustion engine and a drive assembly for transferring the rotational movement of the camshaft of the combustion engine (on which the new system is installed) to the ignition assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Ignition Assembly Adapter System and method of use thereof which has many of the advantages of the combustion engine ignition systems mentioned heretofore and many novel features that result in a new Ignition Assembly Adapter System which is not anticipated, rendered obvious, suggested, or even implied by any of the prior art combustion engine ignition systems, either alone or in any combination thereof.

It is another object of the present invention to provide a new combustion engine Ignition Assembly Adapter System which may be easily and efficiently manufactured and marketed.

It is a further object of the present invention to provide a new combustion engine Ignition Assembly Adapter System which is of a durable and reliable construction.

An even further object of the present invention is to provide a new combustion engine Ignition Assembly Adapter System which is susceptible of a low cost of manufacture with regard to both materials and labor, and which accordingly is then susceptible of low prices of sale to the consuming public, thereby making such combustion Ignition Assembly Adapter System economically available to the buying public.

Still yet another object of the present invention is to provide a new combustion engine Ignition Assembly Adapter System which provides in the apparatuses and methods of the prior art some of the advantages thereof, while simultaneously overcoming some of the disadvantages normally associated therewith.

Still another object of the present invention is to provide a new engine Ignition Assembly Adapter System for permitting the use of ignition systems on combustion engines not originally equipped with ignition systems.

Yet another object of the present invention is to provide a new combustion engine Ignition Assembly Adapter System which includes an ignition assembly support for mounting an ignition assembly (e.g., an ignition distributor) on a combustion engine and further including a drive assembly for transferring the rotational movement of the camshaft of the combustion engine (on which the new system is installed) to the ignition assembly.

These, together with other objects of the invention and along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
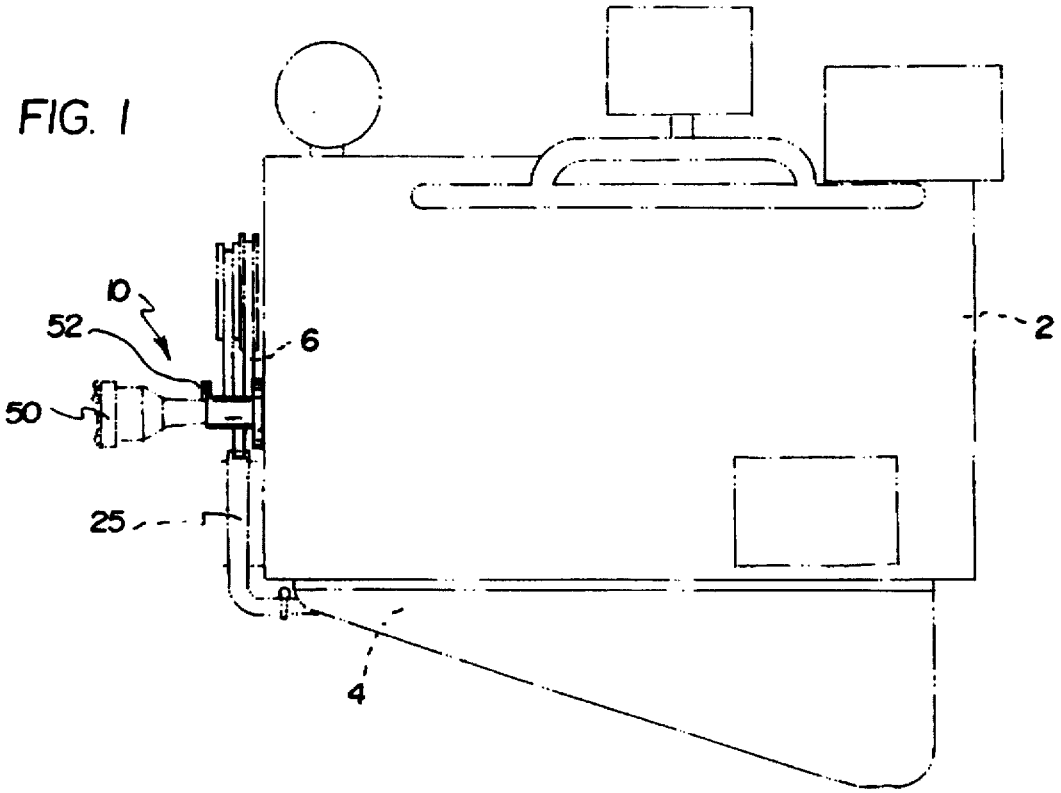
FIG. 1 is a schematic side view of a combustion engine having the new Ignition Assembly Adapter System of the present invention mounted thereon, and particularly illustrating the relationship of the ignition assembly adapter system to an ignition distributor assembly mounted thereon.
Figure 2:
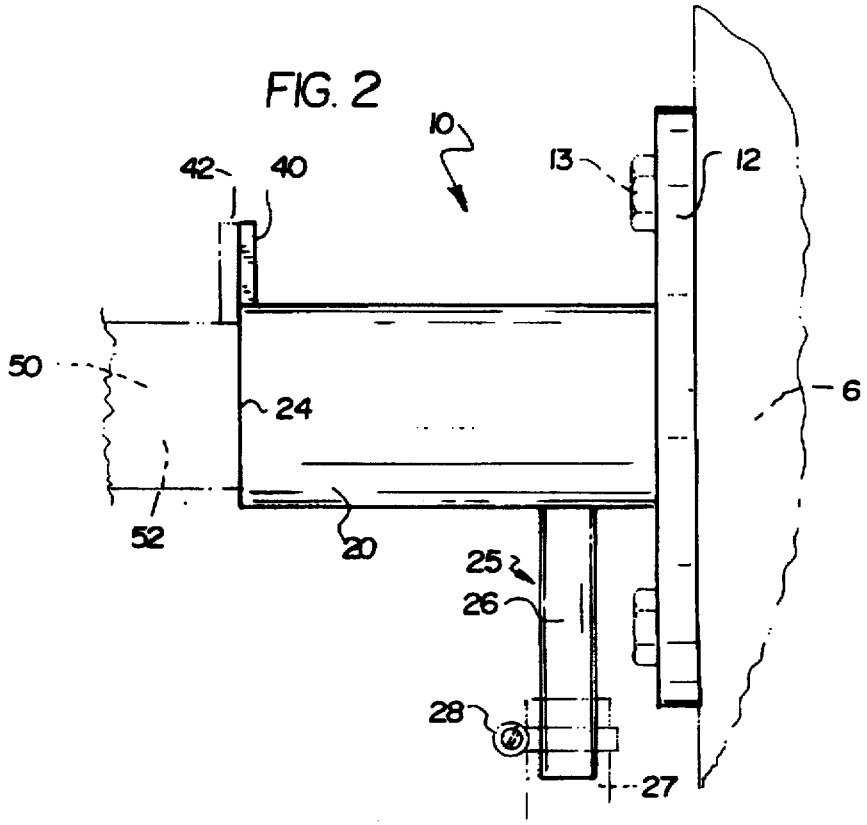
FIG. 2 is a schematic side elevation view of the new ignition assembly adapter system with broken away portions of the ignition distributor and the engine shown in broken lines thereof.
Figure 3:
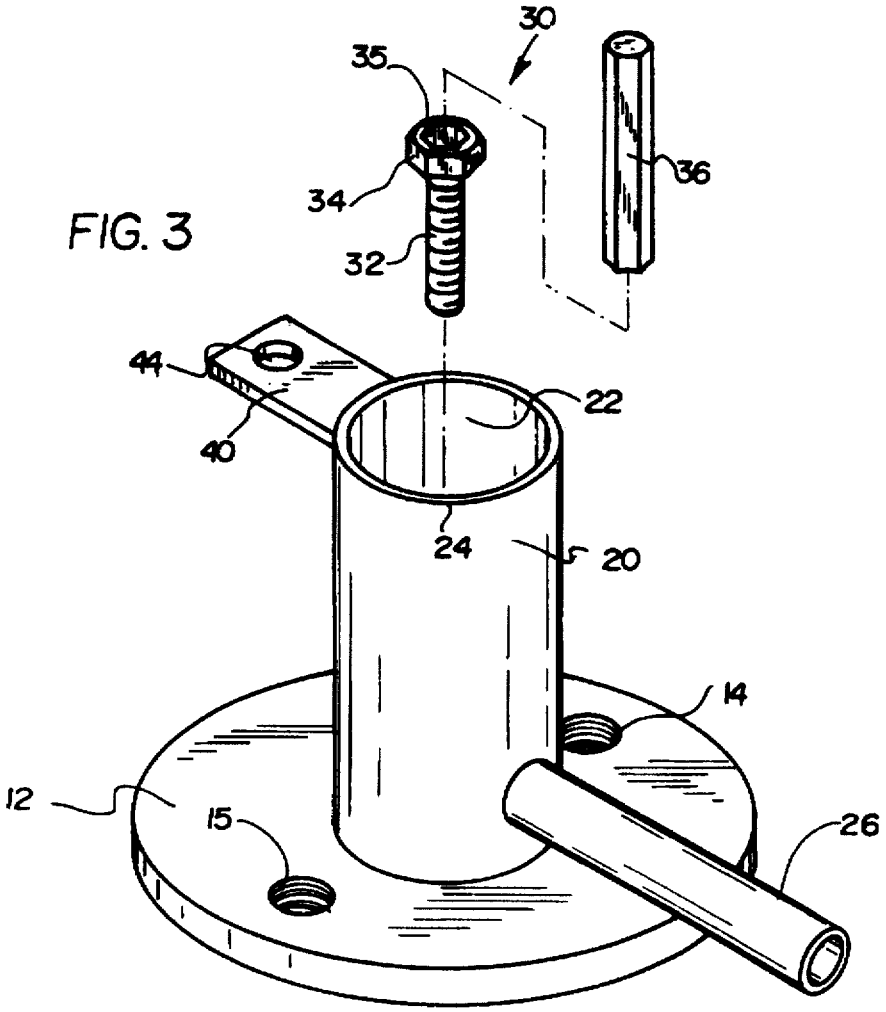
FIG. 3 is a schematic perspective view of the ignition assembly adapter system of the invention particularly illustrating the relationship of the drive assembly components in the sleeve member of the adapter.
Figure 4:
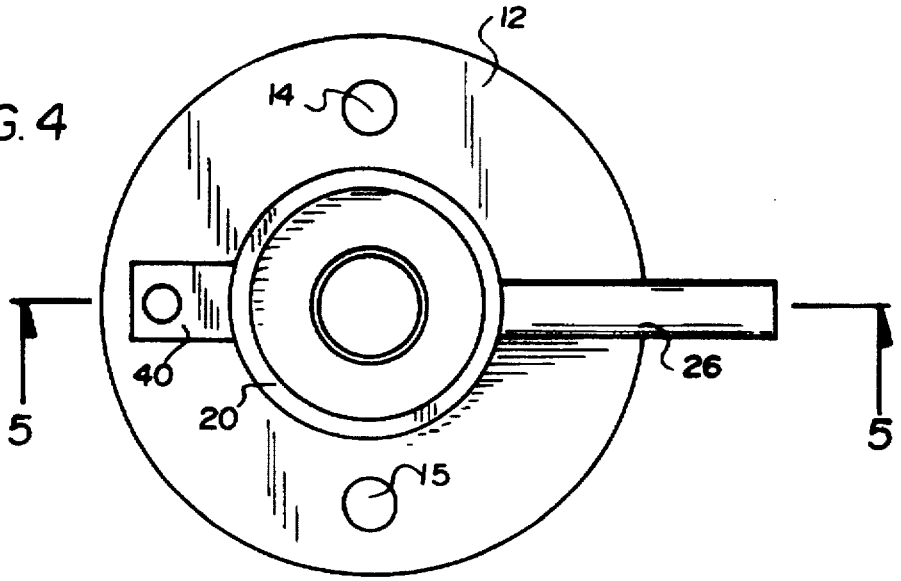
FIG. 4 is a schematic top view of the invention.
Figure 5:
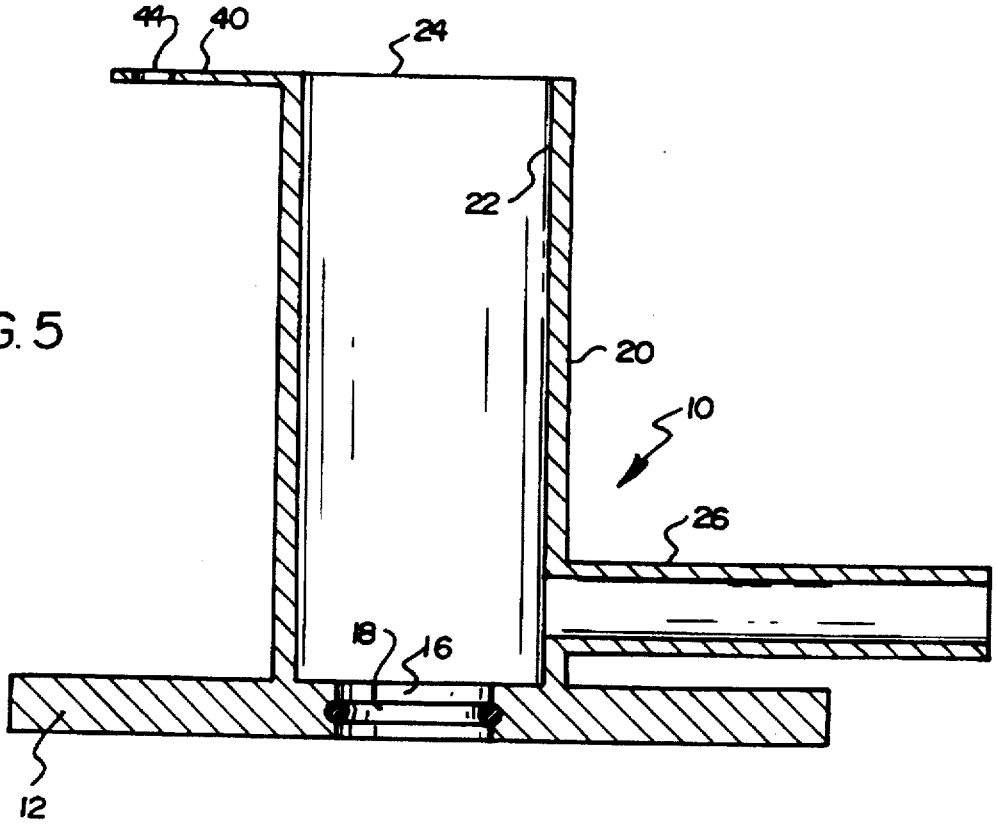
FIG. 5 is a schematic cross sectional view of the ignition assembly adapter taken along line 5—5 of FIG. 4.
Figure 6:
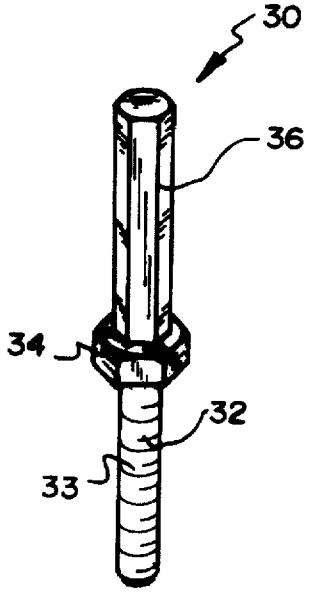
FIG. 6 is a schematic perspective view of the parts of the drive assembly in an assembled condition.

With reference now to the drawings, and in particular to FIGS. 1 through 6 thereof, a new ignition assembly adapter system embodying the principles and concepts of the present invention and generally designated by the reference numeral 10 will be described.

The Ignition Assembly Adapter System 10 is preferably mounted on the exterior of an internal combustion engine 2 (see FIG. 1), and suitably at a location near the front of the engine adjacent to an end of the camshaft (not shown) located inside the engine 2. Most preferably the adapter 10 is mounted on the portion of the engine covering the end of the camshaft, such as the camshaft thrust plate 6 located on the front of the engine 2 (see FIG. 2).

An ignition assembly 36 highly suitable for use with the ignition assembly adapter 10 of the invention has an ignition distributor 50, such as is illustrated in FIG. 1. The preferred ignition distributor 50 is of a conventional and readily available type designed for engines originally equipped with an ignition system. The distributor 50 has a cylindrical shaped mounting portion 52 that is designed (in conventional usage) for insertion into the interior of a combustion engine. The ignition distributor 50 houses a rotatable rotor (not shown) that makes sequential contact with points of the ignition distributor 50 in a conventional manner.

The ignition adapter 10 of the invention forms a support for the ignition assembly distributor 50 in the distributor's mounted position on the exterior of the engine 2. The ignition assembly support comprises an adapter base plate 12 and a sleeve member 20. The adapter base plate 12 is mounted to the cam thrust plate 6 of the engine 2. The most preferred adapter base 12 is a substantially flat and circular plate. The base plate 12 has mounting holes 14, 15 for fastening the adapter 10 to the engine 2, preferably using securing bolts 13 that pass through the base plate 12 and into the cam thrust plate 6. The adapter base plate 12 has an annular aperture 16 that extends through the base plate, and which will be described in more detail below.

The sleeve member 20 of the ignition assembly support receives at least a portion of the cylindrical mounting portion 52 of the ignition distributor 50 (see FIG. 1) for mounting and supporting the ignition distributor on the engine 2. The preferred sleeve member 20 comprises a substantially hollow cylindrical member open at both ends with an interior passage 22 of a diameter sized to provide a relatively snug and secure fit about the mounting portion 52 of an ignition distributor 50 inserted therein. One end of the sleeve member 20 is permanently mounted to the adapter base plate 12 such that the interior passage 22 is aligned with, opens into, and is in communication with the annular aperture 16 of the base plate 12. The aperture 16 is preferably smaller in size or diameter than the size of the passage 22 through the sleeve member 20.

The adapter system 10 of the invention also includes a drive rod assembly 30 for transferring the rotational motion of the engine's camshaft (during engine 2 operation) to the rotor of an ignition distributor 50 received in the sleeve member 20 of the ignition assembly support. The preferred drive rod assembly 30 has a threaded end portion 33 that is threadably mounted or connected to the end of the camshaft of the engine 2, and the opposite end portion has a hexagonal shape that engages the rotor of the ignition distributor 50 for driving the rotor thereof at the same speed as the camshaft driving the threaded end of the drive rod assembly 30. The most preferred drive rod assembly comprises a drive bolt member 32 and a drive shaft member 36. The drive bolt member 32 has a threaded end that forms the threaded end portion 33 of the drive rod assembly 30. The drive bolt member 32 also has a bolt head 34 (opposite the bolt's threaded end) which has a hexagonal recess 35 therein. The hexagonal recess 35 of the bolt head 34 permits the hexagonally-shaped drive shaft member 36 to be inserted in the bolt head 34 in a locking relationship such that the drive bolt member 23 and the drive shaft member 36 rotate together as a unit.

The annular aperture 16 through the adapter base plate 12 is most preferably circular in shape to permit the aperture to form a relatively tight fit about a circular portion of the drive rod assembly 30 passing through the aperture, such as, for example, a smooth portion of the drive bolt member 32 located between the threaded end portion 33 and the bolt head 34. An oil seal 18 may be provided in a groove on the inner annular surface of the aperture 16 (see FIG. 5) for providing a substantially oil tight fit between the adapter base plate 12 and the drive rod assembly 30.

An optional feature of the invention is a oil drain assembly for catching and returning to the oil pan 4 of the engine 2 any oil that may move from the interior of the engine through the cam thrust plate 6 and into the interior passage 22 of the sleeve member 20. The oil drain assembly preferably comprises a drain conduit 15 that is in communication with the interior passage 22 of the sleeve member 20 and the oil pan 4 of the engine 2. The most ideal drain conduit 25 of the invention comprises a drain tube 26 permanently united to the sleeve member 20 and opening into the interior passage 22 thereof. A flexible drain hose 27 is connected on one end to the free or open end of the drain tube 26 (preferably using a drain hose clamp 28) and the other end is connected to a similar tube in communication with the interior of the oil pan 4 (see FIG. 1).

An additional optional feature of the invention is a hold down bracket 40 united to the outer end 24 of the sleeve member 20. The preferred hold down bracket 40 extends radially outward from the outer end 24 of the sleeve member 20. The bracket 40 has a hole 44 therein which may be aligned with a hole (not shown) in a hold down tab 42 united to the ignition distributor 50. Optionally, other means of retaining the ignition distributor in the interior passage of the sleeve member may also be provided.

The ignition assembly adapter system 10 of the invention permits the mounting of an ignition distributor 36 (such as shown in FIG. 1) on an engine 2 in a manner that permits the internal rotor (not shown) of the distributor to be turned or rotated at the same speed as the camshaft of the engine 2.

Installation of the ignition assembly adapter on a combustion engine may be accomplished by machining a hole through the cam thrust plate 6 in a location inline with the an end of the camshaft of the engine. The end of the camshaft, sometimes referred to as the nose of the camshaft, is preferably provided with a pipe plug (not shown) within a threaded recess in the nose of the camshaft. The threaded pipe plug is removed from the nose of the camshaft so that the threaded recess may receive the threaded end portion 33 of the drive rod assembly 30. The base plate 12 of the ignition assembly adapter 10 is then mounted against the outer surface of the cam thrust plate 6 using the securing bolts 13. The threaded end portion 33 of the drive bolt member 32 is threaded into the threaded recess in the nose end of the camshaft, and suitably tightened in the recess such that the drive rod assembly 30 is rotated by the camshaft. The hexagonal end portion of the drive rod assembly is inserted or forcibly driven into the hexagonal shaped recess 35 in the bolt head 34 of the drive bolt member. The cylindrical mounting portion 52 of the ignition distributor 50 is inserted into the circular interior passage 22 of the sleeve member 20 so that an end of the hexagonal drive shaft member 36 moves into and is held in a similarly sized hexagonal channel (not shown) in the end of the distributor rotor. The drive rod assembly 30 is thus rotated by the camshaft and the drive rod assembly in turn rotates the distributor rotor of the ignition distributor 50.

The ignition assembly adapter of the invention permits the installation of ignition systems, and especially highly efficient and reliable electronic ignition systems, on combustion engines originally manufactured or supplied without an ignition system (or provides the ability to replace or bypass a less efficient or defective ignition system) with an ignition system comprised of easily obtainable and highly standardized ignition distributor system parts available in automobile parts stores. In addition to the ignition distributor, other ignition system components may also be used in the ignition system including an ignition coil (not shown), an electronic ignition module (not shown) and other components as may be needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An Ignition Assembly Adaptel System permitting the use of an ignition assembly on a combustion engine having a camshaft, said ignition assembly being of the type having an ignition distributor with a cylindrical mounting portion housing a rotor, said adapter system comprising:

an ignition assembly support for supporting an ignition distributor in a position external to a said combustion engine, said ignition assembly support comprising an adapter base plate and a sleeve member fixedly united together for mounting on the exterior of a combustion engine at a location adjacent to the camshaft of said combustion engine, said sleeve member having an interior passage for receiving the cylindrical mounting portion of an ignition distributor, said adapter base plate having an annular aperture therethrough and opening into the interior passage of said sleeve member, and a drive assembly for transferring rotational motion of the camshaft of said combustion engine to an ignition distributor received in the sleeve member of said ignition assembly support, said drive assembly being mountable to an end of said camshaft for rotation therewith and being connectable to the rotor in the cylindrical mounting portion of said ignition distributor such that said drive assembly transmits rotation of said camshaft to the rotor of said ignition distributor.

2. The Ignition Assembly Adapter System of claim 1 wherein said drive assembly comprises a drive rod having a threaded end portion for being threadably received in an end of the camshaft of a combustion engine.

3. The Ignition Assembly Adapter System of claim 2 wherein said drive rod has a hexagonal shaped end portion opposite said threaded end portion, said hexagonal end portion being for engaging the rotor of said ignition distributor.

4. The ignition assembly adapter system of claim 3 wherein said drive rod comprises a threaded drive bolt member and a hexagonal drive shaft member, said drive bolt member having a head portion with a recess therein for receiving an end of said drive shaft member.

5. The Ignition Assembly Adapter System of claim 1 wherein the combustion engine includes an oil pan for receiving engine oil, and wherein said ignition assembly support additionally comprises a drain conduit in communication with the interior passage of said sleeve member and also in communication with the oil pan of said engine to permit any engine oil entering said interior passage to drain from said interior passage to said oil pan.

6. The Ignition Assembly Adapter System of claim 5 wherein said drain conduit comprises a drain tube fixedly united to said sleeve member and a flexible drain hose connected to said drain tube and connected to the oil pan of said engine.

7. The ignition assembly adapter system of claim 1 wherein said ignition assembly support additionally comprises a hold down bracket mounted on the sleeve member thereof for attaching to a hold down tab on the cylindrical mounting portion of said ignition distributor.

* * * * *